US005148082A

United States Patent [19]

Itou et al.

[11] Patent Number: 5,148,082

[45] Date of Patent: Sep. 15, 1992

[54] COLOR PICTURE TUBE WITH LIGHT ABSORBING LAYER ON SCREEN

[75] Inventors: Takeo Itou, Kumagaya; Hidemi Matsuda, Oomiya; Hajime Tanaka, Fujioka; Kazuhiko Shimizu, Fukaya, all of Japan

[73] Assignee: Kabushiki Kaisha Toshiba, Kawasaki, Japan

[21] Appl. No.: 833,826

[22] Filed: Feb. 13, 1992

Related U.S. Application Data

[63] Continuation of Ser. No. 551,008, Jul. 11, 1990, abandoned.

[30] Foreign Application Priority Data

Jul. 11, 1989 [JP] Japan ..... 1-178220

[51] Int. Cl.[5] ..... H01J 29/30; H01J 29/32

[52] U.S. Cl. ..... 313/466; 313/474; 313/472

[58] Field of Search ..... 313/466, 474, 472

[56] References Cited

U.S. PATENT DOCUMENTS 3,614,503 10/1971 Dietch ..... 313/472
3,614,504 10/1971 Kaplan ..... 313/472
3,661,580 5/1972 Mayaud ..... 313/472 X
3,863,086 1/1975 Speigel ..... 313/472 X

FOREIGN PATENT DOCUMENTS 52-74274 6/1977 Japan .

*Primary Examiner*—Palmer C. DeMeo
*Attorney, Agent, or Firm*—Cushman, Darby & Cushman

[57] ABSTRACT

A color picture tube comprising an envelope including a front panel, a phosphor screen formed in the inner surface of the front panel, and an electron gun arranged in the envelope. The phosphor screen includes a light absorbing layer having a plurality of holes and phosphor layers formed in the holes so as to partially overlap the light absorbing layer. The transmittance T of the light absorbing layer, the ratio a of the area of a light emitting region in a portion where the light absorbing layer overlaps the phosphor layers to the area of the phosphor screen, the ratio b of the area of the light absorbing layer to the area of the phosphor screen, and the ratio r of the light emitting region in the holes to the area of the holes satisfy the following relational expression: $1/T \geqq \frac{1}{2}\{(rb/a)-[a/(1-b)r]\}$.

4 Claims, 2 Drawing Sheets

COLOR PICTURE TUBE WITH LIGHT ABSORBING LAYER ON SCREEN

This is a continuation of application Ser. No. 07/551,008, filed on Jul. 11, 1990, which was abandoned upon the filling hereof.

BACKGROUND OF THE INVENTION

1. Field of the Invention

This invention relates to a color picture tube having an improved phosphor screen.

2. Description of the Related Art

In recent years, a color picture tube called "black matrix type color picture tube" is widely used, in which light absorbing layers fill a guard band region among phosphor dots constituting a phosphor screen. In this color picture tube, light absorbing layer 12 is formed in a predetermined region of panel 2 as shown in FIGS. 2 to 4. Phosphor layers 14 are formed in hole regions 13 partitioned by light absorbing layer 12. As is shown in FIG. 4, phosphor layers 14 not only exist in hole regions 13 but overlap light absorbing layers 12.

Since phosphor layers 14 partially overlap light absorbing layer 12, light emitted from overlap portion 14*a* of phosphor layer 14 is absorbed by light absorbing layer 12, not contributing to display. This inevitably prevents improvement on that brightness of the phosphor screen.

To overcome the drawback, a light absorbing layer having 5 to 40% light absorbance is used as proposed in, for example, Published Unexamined Japanese Patent Application No. 52-74274. This light absorbing layer allows passage of the light emitted from the overlap portion of the phosphor layer, thereby improving brightness. It is true that brightness of the phosphor screen can be improved by the light absorbing layer which transmits light. However, if the light transmittance of the light absorbing layer is too high, the ambient light reflectivity is also high, inevitably lowering the contrast. If the light transmittance is set low so as to suppress the outer light reflectivity, it is difficult to obtain sufficient brightness.

SUMMARY OF THE INVENTION

It is accordingly an object of the present invention to provide a color picture tube by which high brightness is obtained without lowering the contrast.

According to the present invention, there is provided a color picture tube comprising an envelope including a front panel, a phosphor screen formed in the inner surface of the front panel, and an electron gun arranged in the envelope, the phosphor screen including a light absorbing layer having a plurality of holes and phosphor layers formed in the holes so as to partially overlap the light absorbing layer, and the transmittance T of the light absorbing layer, the ratio a of the area of a light emitting region in a portion where the light absorbing layer overlaps the phosphor layers to the area of the phosphor screen, the ratio b of the area of the light absorbing layer to the area of the phosphor screen, and the ratio r of the light emitting region in the holes to the area of the holes satisfying the following relational expression: $1/T \geqq \frac{1}{2}\{(rb/a)-[a/(1-b)r]\}$.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DETAILED DESCRIPTION OF THE PREFERRED EMBODIMENT

A preferred embodiment of the present invention will now be described with reference to the accompanying drawings.

Figure 1:
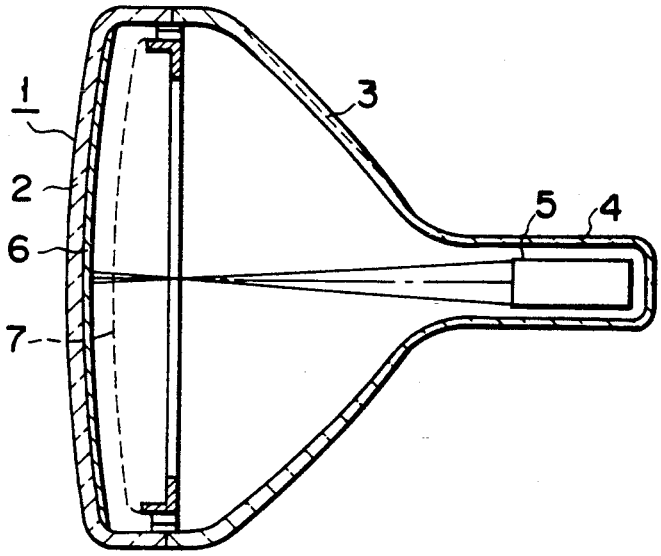
FIG. 1 is a cross-sectional view showing a color picture tube according to an embodiment of the present invention.

FIG. 1 is a cross-sectional view showing a color picture tube according to an embodiment of the present invention. As shown in FIG. 1, envelope 1 made of glass is constituted by front panel 2 and funnel 3 which are bonded integral with each other. Electron gun 5 which emits electron beams is arranged in neck 4 of funnel 3. Phosphor screen 6 is formed on the inner surface of panel 2, so as to oppose to electron gun 5. Shadow mask 7 having a plurality of apertures is formed between phosphor screen 6 and electron gun 5, such that electron beams from electron gun 5 pass through the apertures.

Figure 2:
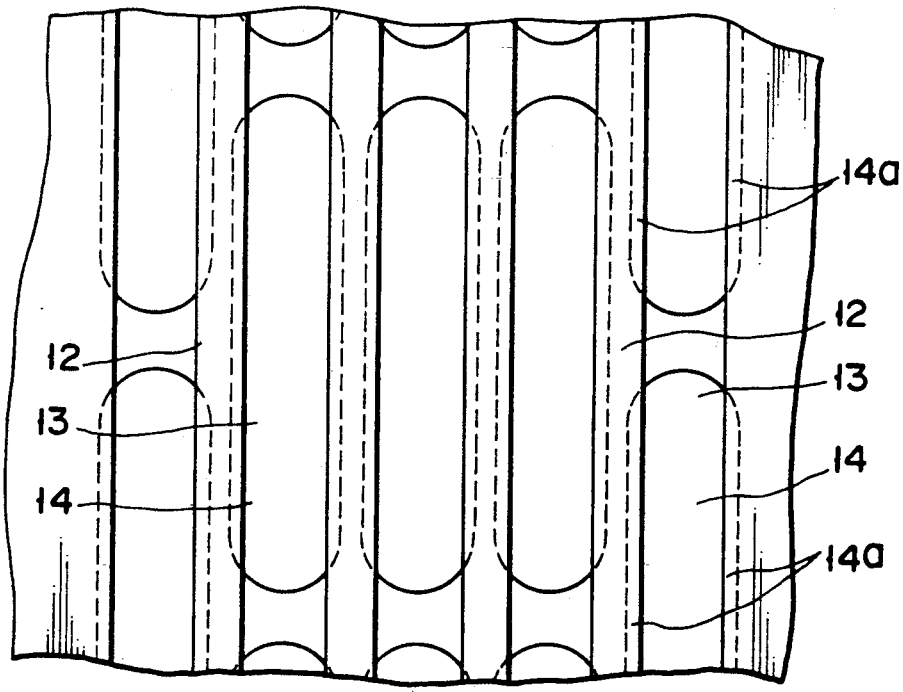
FIG. 2 is a plan view showing a stripe type phosphor screen of the color picture tube shown in FIG. 1.
Figure 3:
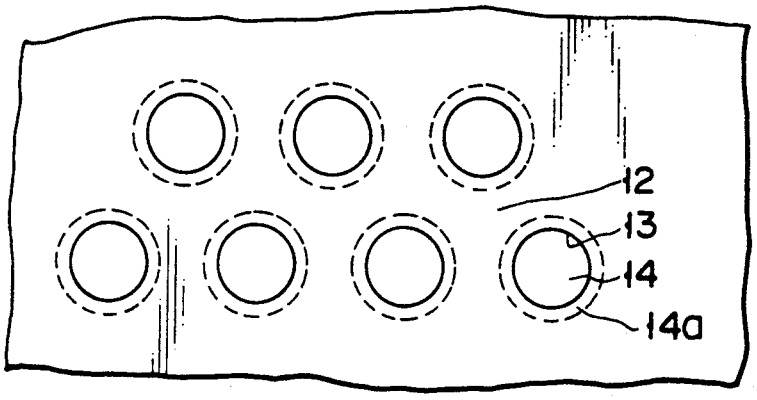
FIG. 3 is a plan view showing a dot type phosphor screen of the tube shown in FIG. 1.
Figure 4:
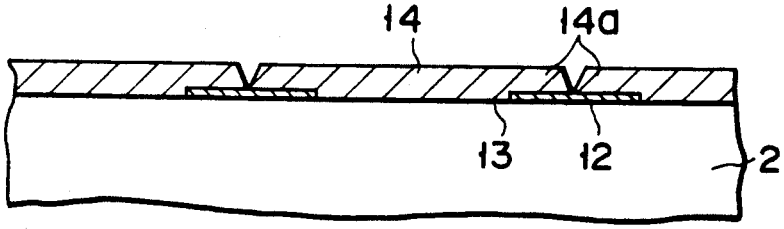
FIG. 4 is a cross-sectional view of the stripe type phosphor screen shown in FIG. 2.

FIGS. 2 and 3 are plan views showing the black matrix type phosphor screen of the color picture tube shown in FIG. 1: FIG. 2 shows a stripe type phosphor screen; and FIG. 3 shows a dot type phosphor screen. FIG. 4 is a cross-sectional view of the phosphor screen shown in FIG. 2 or FIG. 3.

In FIGS. 2 to 4, light absorbing layer 12 of a predetermined pattern is formed on the inner surface of panel 2 which is a part of the envelope of the color picture tube. The regions, in which no light absorbing layer 12 is formed, correspond to striped or dot-shaped holes 13. Phosphor layers 14 are formed in holes 13: however, not only in holes 13 but also on end portions of light absorbing layer 12. The portions, in which phosphor layers 14 overlap light absorbing layer 12, are identified with a reference numeral 14*a*. Light absorbing layer 12 may be made of graphite.

In the phosphor screen as described above, light transmittance T of light absorbing layer 12 is set to a predetermined value such that, when electron gun 5 emits electron beams toward phosphor screen 6, the light emitted from the overlap portions 14*a* transmits to panel 2.

The inventors studied the relationship among the light transmittance T of light absorbing layer 12, the brightness, and the contrast. As a result, they found that the contrast reduction is determined not only by the light transmittance T of light absorbing layer 12 but also by the relationship between the light transmittance T, the ratio a of the area of the light emitting regions of the overlap portions 14a to the area of the phosphor screen 6, and the ratio b of the area of light absorbing layer 12 to the area of phosphor screen 6.

When the light transmittance of light absorbing layer 12 is 0, as in the conventional phosphor screen, the brightness $B_0$ is obtained by the following equation (1) in a case where holes 13 are stripe shaped as shown in FIG. 2:

$$B_0=(1-b)\cdot r\cdot B_3 \quad (1)$$

where r is the ratio of the area of holes 13 to the area of the light emitting region of the phosphor layer, and $B_3$ is the average brightness of the three colors of phosphor layer 14.

On the other hand, when the light transmittance of light absorbing layer 12 is T, brightness $B_T$ of the phosphor screen is obtained by the following equation (2) in a case where holes 13 are stripe shaped as shown in FIG. 2:

$$B_T=(1-b)\cdot r\cdot B_3+a\cdot T\cdot B_3 \quad (2)$$

From the equations (1) and (2), the following equation (3) is obtained:

$$B_T/B_0=1+aT/(1-b)\cdot r \quad (3)$$

In a case where holes 13 are dot-shaped, r=1 in equation (3).

When the light transmittance is 0, the outer light reflectivity $R_0$ is obtained by the following equation (4):

$$R_0=(1-b)R_3 \quad (4)$$

where $R_3$ is the average reflectivity of the three colors of phosphor layer 14.

When the light transmittance is T, the ambient light reflectivity $R_T$ is obtained by the following equation (5):

$$R_T=(1-b)R_3+bR_3T^2 \quad (5)$$

From the equations (4) and (5), the following equation (6) is obtained:

$$R_T/R_0=1+[b/(1-b)]T^2 \quad (6)$$

In the above equations (3) and (6), $B_T/B_0$ means the increasing rate $\Delta B$ of the brightness, and $R_T/R_0$ means the increasing rate $\Delta R$ of the ambient light reflectivity. The contrast increases when the rates $\Delta B$ and $\Delta R$ have the following relationship.

$$BCP=\Delta B/\sqrt{\Delta R}\geqq 1 \quad (7)$$

BCP (Brightness Contrast Performance) is a barometer to appraise the improvement of the contrast, i.e., the rate of the improvement of the contrast. If the value of BCP is larger than 1, in other words, the equation (7) is satisfied, the contrast is enhanced, in which case, to increase the rate $\Delta B$ of the brightness is more effective than to increase the light transmittance of panel 2. On the other hand, if the value of BCP is less than 1, to increase the light transmittance of panel 2 is more effective to obtain an improved contrast.

The following equation (8) is derived by substituting equations (3) and (6) into the equation (7).

$$BCP=\frac{B_T/B_O}{\sqrt{(R_T/R_O)}}=\frac{1+[a/(1-b)r]T}{\sqrt{(1+[b/(1-b)]T^2)}}\geqq 1. \quad (9)$$

From the above equation (8), the equation (9) indicated below will be obtained. Hence, to satisfy the equation (8), the above-mentioned area rates a, b, and r must be set to such values that satisfies the equation (9). In other words, only in the case where the equation (9) is satisfied, the brightness can be improved without lowering the contrast assuming that the transmittance is T.

$$f(a,b,c,)=\tfrac{1}{2}[(rb/a)-a/(1-b)r]\geqq 1/T \quad (9)$$

If holes 13 are dot-shaped as shown in FIG. 3, r=1 in the equation (9).

According to the present invention, it is preferable that the light transmittance T of the light absorbing layer fall within a range 0.2 to 0.7. If the light transmittance is less than 0.2, the brightness is reduced as compared to that obtained by the conventional phosphor screen; if it is more than 0.7, the contrast is reduced.

Next, examples of the present invention will be described.

EXAMPLE 1

Prepared was a color display tube of the 25 inch size, comprising a stripe type phosphor screen having light absorbing layer 12 in which the transmittance T is 0.5. In the tube, the horizontal pitch of the stripes is 800 μm, the vertical pitch thereof is 1150 μm, the length of the vertical axis of the beam spot is 1050 μm, and holes are 180 μm width. The length of the horizontal axis of the beam spot was changed, thereby changing the value of "a" the ratio of the area of the light emitting portion in which light absorbing layer 12 overlaps phosphor layer 14 to the area of the phosphor screen). Each time the size of the beam spot was changed, the brightness and the ambient light reflectivity were measured. The results is shown in Table 1 below. The values of a, b, and r are not average values in the entire phosphor screen, but the values of a portion of the screen. The values of a, b, and r are set such that the above equation (9) is satisfied with respect to, for example, the center portion, or a peripheral portion.

TABLE 1

| Length of the horizontal axis of the beam spot | a | b | r | f (a, b, r) | ΔB | ΔR | BCP |
|---|---|---|---|---|---|---|---|
| 180 μm | 0 | 0.33 | 0.86 | ∞ | 0.99 | 1.11 | 0.94 |
| 200 μm | 0.06 | 0.33 | 0.87 | 2.34 | 1.05 | 1.12 | 0.99 |
| 230 μm | 0.14 | 0.33 | 0.87 | 0.90 | 1.12 | 1.11 | 1.06 |
| 250 μm | 0.20 | 0.33 | 0.87 | 0.55 | 1.17 | 1.11 | 1.11 |

As can be seen from Table 1, since the light transmittance is 0.5, when the length of the horizontal axis of the beam spot is 180 μm or 200 μm, BCP is smaller than 1. In this case, f(a,b,r) is larger than 1/T, i.e. 2, which does not satisfy the above equation (7) and (9). Hence, the contrast is not improved. On the other hand, when the length of the horizontal axis of the beam spot is 230 μm or 250 μm, BCP is larger than 1, and f(a,b,r) is smaller than 2, thus satisfying the above equations (7) and (9). As a result, the contrast is improved.

As is described above, if the values of a, b, and r are set so that the relation $\tfrac{1}{2}\{(rb/a)-[a/(1-b)r]\}\leqq 2$ is satisfied, both the contrast and the brightness are improved.

EXAMPLE 2

In the same color display tube as used in Example 1, the length of the horizontal axis of the beam spot was changed, thereby changing the value of a, with respect to the cases where the light transmittance T is 0.2, 0.3, and 0.7. In each case, the brightness and the ambient light reflectivity was measured. The results are shown in Tables 2, 3, and 4.

TABLE 2

| Length of the horizontal axis of the beam spot | In a case where transmittance is 0.2 | | | | | | |
|---|---|---|---|---|---|---|---|
| | a | b | r | f (a, b, r) | ΔB | ΔR | BCP |
| 180 μm | 0 | 0.33 | 0.86 | ∞ | 0.99 | 1.02 | 0.99 |
| 200 μm | 0.06 | 0.33 | 0.87 | 4.68 | 1.02 | 1.02 | 1.01 |
| 230 μm | 0.14 | 0.33 | 0.87 | 1.81 | 1.05 | 1.03 | 1.03 |
| 250 μm | 0.20 | 0.33 | 0.87 | 1.09 | 1.07 | 1.02 | 1.06 |

TABLE 3

| Length of the horizontal axis of the beam spot | In a case where transmittance is 0.3 | | | | | | |
|---|---|---|---|---|---|---|---|
| | a | b | r | f (a, b, r) | ΔB | ΔR | BCP |
| 180 μm | 0 | 0.33 | 0.86 | ∞ | 0.99 | 1.04 | 0.97 |
| 200 μm | 0.06 | 0.33 | 0.87 | 2.34 | 1.04 | 1.04 | 1.02 |
| 230 μm | 0.14 | 0.33 | 0.87 | 0.90 | 1.07 | 1.03 | 1.05 |
| 250 μm | 0.20 | 0.33 | 0.87 | 0.55 | 1.10 | 1.04 | 1.07 |

TABLE 4

| Length of the horizontal axis of the beam spot | In a case where transmittance is 0.7 | | | | | | |
|---|---|---|---|---|---|---|---|
| | a | b | r | f (a, b, r) | ΔB | ΔR | BCP |
| 180 μm | 0 | 0.33 | 0.86 | ∞ | 0.99 | 1.23 | 0.89 |
| 200 μm | 0.06 | 0.33 | 0.87 | 2.34 | 1.07 | 1.23 | 0.96 |
| 230 μm | 0.14 | 0.33 | 0.87 | 0.90 | 1.16 | 1.24 | 1.04 |
| 250 μm | 0.20 | 0.33 | 0.87 | 0.55 | 1.24 | 1.24 | 1.11 |

As is obvious from Tables 2, 3, and 4, in a case where $f(a,b,r) \leqq 1/T$, the value of BCP is 1 or larger, resulting in a satisfactory contrast.

EXAMPLE 3

Prepared was a color display tube of the 25 inch size, comprising a stripe type phosphor screen having light absorbing layer 12 in which the transmittance T is 0.5. In the tube, the horizontal pitch of the stripe is 800 μm, the vertical pitch thereof is 1150 μm, the length of the horizontal axis of the beam spot is 210 μm, and holes are 180 μm width. The length of the vertical axis of the beam spot was changed, thereby changing the values of a and r. In each case, the brightness and the ambient light reflectivity were measured. The results is shown in Table 5.

TABLE 5

| Length of the vertical axis of the beam spot | a | b | r | f (a, b, r) | ΔB | ΔR | BCP |
|---|---|---|---|---|---|---|---|
| 300 μm | 0.04 | 0.33 | 0.63 | 2.6 | 1.05 | 1.12 | 0.99 |
| 700 μm | 0.07 | 0.33 | 0.79 | 1.8 | 1.06 | 1.11 | 1.01 |
| 1050 μm | 0.08 | 0.33 | 0.86 | 1.7 | 1.07 | 1.12 | 1.01 |
| 1400 μm | 0.09 | 0.33 | 0.90 | 1.6 | 1.07 | 1.12 | 1.01 |

As can be seen from Table 5, similarly to the results of Examples 1 and 2, in a case where the condition $f(a,b,r) \leqq 1/T$ was satisfied, the brightness was improved without lowering the contrast.

As is obvious from the above Examples 1 to 3, if the values a, b, and r are set such that the condition $f(a,b,r) \leqq 1/T$ is satisfied, the color picture tube with improved brightness and contrast can be obtained.

If the value of r is set to 1, the present invention can be applied to a black matrix type color picture tube having a dot type phosphor screen, or a black stripe type color picture tube of the aperture grill type.

As has been described above, according to the present invention, a color picture tube with satisfactory brightness and contrast is obtained with ease.

Additional advantages and modifications will readily occur to those skilled in the art. Therefore, the invention in its broader aspects is not limited to the specific details, and representative devices, shown and described. Accordingly, various modifications may be made without departing from the spirit or scope of the general inventive concept as defined by the appended claims and their equivalents.

We claim:

1. A color picture tube comprising:

an envelope including a front panel;

a phosphor screen formed on the inner surface of the front panel; said phosphor screen including a light absorbing layer having a plurality of holes and phosphor layers formed in the holes and partially overlapping the light absorbing layer; and where the transmittance T of the light absorbing layer, the ratio a of the area of a light emitting region in a portion where the light absorbing layer overlaps the phosphor layers to the area of the phosphor screen, the ratio b of the area of the light absorbing layer to the area of the phosphor screen, and the ratio r of the area of the light emitting region in the holes to the area of the holes satisfy the following relational expressions: $1/T \geqq \frac{1}{2}\{(rb/a) - [a/(1-b)r]\}$ and $BCP = \{1+[a/(1-b)r]T\}/\{1+[b/(1-b)]T^2\} \geqq 1.06$ where the transmittance T is within a range of 0.2 to 0.7 and BCP, a color picture tube brightness contrast relation, indicates that for a BCP value greater than one color picture tube brightness can be increased without lowering contrast; and an electron gun arranged in the envelope.

2. A color picture tube according to claim 1, wherein said holes are stripe-shaped.

3. A color picture tube according to claim 1, wherein said holes are dot-shaped and the value of the ratio r is 1.

4. A color picture tube according to claim 1, wherein said light absorbing layer is made of graphite.

* * * * *